US008235363B2

(12) United States Patent
Samyn et al.

(10) Patent No.: US 8,235,363 B2
(45) Date of Patent: Aug. 7, 2012

(54) AIR-COOLED HEAT EXCHANGER WITH HYBRID SUPPORTING STRUCTURE

(75) Inventors: Philippe Samyn, Brussels (BE); Miguel Paternostre, Brussels (BE); Francois Van Rechem, Brussels (BE); Ben Verbeeck, Berchem (BE); Michel Vouche, Brussels (BE)

(73) Assignee: SPX Cooling Technologies, Inc., Overland Park, KS (US)

( * ) Notice: Subject to any disclaimer, the term of this patent is extended or adjusted under 35 U.S.C. 154(b) by 873 days.

(21) Appl. No.: 12/242,460

(22) Filed: Sep. 30, 2008

(65) Prior Publication Data

US 2010/0078147 A1 Apr. 1, 2010

(51) Int. Cl.
*B01F 3/04* (2006.01)

(52) U.S. Cl. ..... 261/108; 261/DIG. 11; 165/47; 52/651.07

(58) Field of Classification Search ..... 261/108, 261/112.1, DIG. 11; 165/47; 52/167.3, 223.3, 52/651.07, 651.09
See application file for complete search history.

(56) References Cited

U.S. PATENT DOCUMENTS

| | | | | |
|---|---|---|---|---|
| 2,709,975 | A | 6/1955 | Parker | |
| 3,429,129 | A | 2/1969 | Johansson et al. | |
| 3,721,290 | A * | 3/1973 | Butler, Jr. | 165/85 |
| 3,938,476 | A | 2/1976 | Kaupp | |
| 4,036,916 | A * | 7/1977 | Agsten | 261/109 |
| 4,148,850 | A * | 4/1979 | Schulte et al. | 261/109 |
| 4,199,906 | A * | 4/1980 | Jasch et al. | 52/63 |
| 4,267,130 | A | 5/1981 | Curtis | |
| 4,416,836 | A * | 11/1983 | Sinek | 261/112.1 |
| 4,520,600 | A * | 6/1985 | Bordet | 52/83 |
| 4,543,218 | A * | 9/1985 | Bardo et al. | 261/24 |
| 4,632,787 | A * | 12/1986 | Tippmann | 261/30 |
| 4,976,895 | A * | 12/1990 | Bardo | 261/108 |
| 5,028,357 | A * | 7/1991 | Bardo | 261/111 |
| 5,236,625 | A * | 8/1993 | Bardo et al. | 261/24 |
| 2001/0045069 | A1 * | 11/2001 | Constantinou | 52/167.3 |
| 2002/0024156 | A1 * | 2/2002 | Flaherty | 261/109 |
| 2006/0243430 | A1 | 11/2006 | Vouche et al. | |
| 2008/0017448 | A1 | 1/2008 | Hayes, Sr. | |

FOREIGN PATENT DOCUMENTS

| | | | |
|---|---|---|---|
| GB | 1251655 | A | 10/1971 |
| SU | 567078 | * | 7/1977 |

* cited by examiner

*Primary Examiner* — Charles Bushey
(74) *Attorney, Agent, or Firm* — Baker & Hostetler LLP

(57) ABSTRACT

A cooling tower module features at least one heat exchange panel, a central column, a horizontal beam extending outward from the central column, and a first side structure connected to the horizontal beam to support the horizontal beam and connected to the panel to provide support to the at least one heat exchange panel. A cooling tower facility has one or more modules. The facility can cool fluid or condense steam by interaction with ambient air.

15 Claims, 15 Drawing Sheets

AIR-COOLED HEAT EXCHANGER WITH HYBRID SUPPORTING STRUCTURE

FIELD OF THE INVENTION

The invention relates to heat exchanger structures, and in particular air-cooled heat exchangers.

BACKGROUND OF THE INVENTION

Heat exchanger tower structures are in wide use in industry. Among the many types of heat exchanger towers, also often referred to as cooling towers, are towers that utilize tube bundle panels which are flat panels comprising a number of parallel running tubes. The tubes may in some cases have fins to assist with heat exchange. These structures are used, for example, to condense steam or to cool warm fluid such as process fluid from an industrial process. In the case of use to condense steam, they are often referred to as air cooled condensers. The warm fluid or steam, often from an industrial process, is supplied to the panels and flows through the tubes in the panels and is cooled by the tube bundle panels being in contact with ambient air. The condensate or cooled fluid is recovered from the panels and can be re-supplied to the industrial process.

In one type of heat exchanger tower structure, one or more tube bundle panels are oriented vertically and form one or more sides of a geometric tower structure, often referred to as a cell or module. The module may be square or rectangular in plan view, for example, or may be hexagonal in plan view. Often a plurality of such geometric tower structures are placed next to each other in rows, thus forming a combined tower facility that has a plurality of individual modules or cells. In some or all cases, the tube panels may be angled also relative to vertical. The tube bundle panels can be quite large and heavy, and a support structure is needed to support the tube panel bundles in their vertical positions, along with structure to support an outlet fan which may be located at the top of the cell. Other components of a module also need to be supported. Heretofore, this supporting structure has often been an on-site constructed frame structure in keeping with known cooling tower building procedures. However, it is always desirable to reduce the costs of labor and materials involved in erecting and operating such a structure. It is also desirable to develop one or more relatively standardized module configurations that can be erected and used quickly and easily.

SUMMARY OF THE INVENTION

An embodiment of the present invention is a cooling tower module with at least one heat exchange panel, a central column, a horizontal beam extending outward from the central column, and a first side structure connected to the horizontal beam to support the horizontal beam and connected to the panel to provide support to the at least one heat exchange panel.

Another embodiment features a cooling tower module with at least one heat exchanging means, a central vertical supporting means, a horizontal supporting means extending outward from the central vertical supporting means, and a first side structure connected to the horizontal supporting means to support the horizontal supporting means and connected to the panel to provide support to the at least one heat exchanging means.

Yet another embodiment of the present invention comprises a method for cooling fluid using a cooling tower module which supports at least one heat exchange panel using a central column, a horizontal beam extending outward from the central column, and a first side structure connected to the horizontal beam to support the horizontal beam and connected to the panel to provide support to the at least one heat exchange panel, and which passes fluid through the heat exchange panel to cool the fluid.

In another embodiment, a cooling tower facility includes a plurality of modules wherein each module has at least one heat exchange panel, a central column, a horizontal beam extending outward from the central column, and a first side structure connected to the horizontal beam to support the horizontal beam and connected to the panel to provide support to the at least one heat exchange panel.

A further embodiment of the invention includes a cooling tower module with four sides and a first pair of heat exchange panels having an internal angle and adjacent each other to form two sides of the modules. The module also comprises a second pair of heat exchange panels having an internal angle forming the opposite two sides of the module from the first pair, and a first side support structure forming one of the sides in between the panels. In addition, a second support structure forming the opposite side between the two panels from the first support structure, and a space truss horizontal beam extending from the first side support to the second side support is disclosed.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
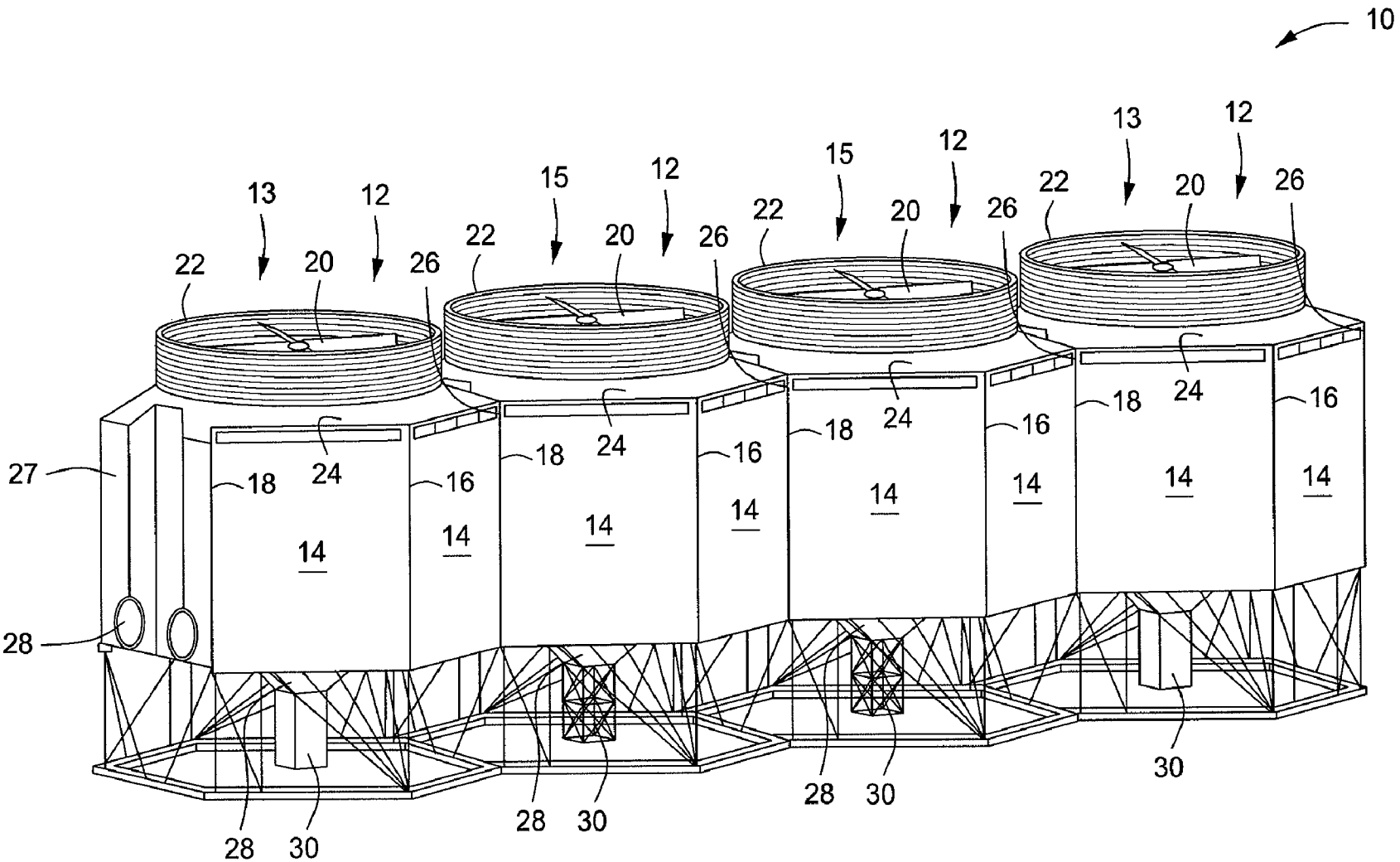
FIG. 1 is a perspective view showing four cooling tower modules arranged in a row to form a cooling facility.

Some embodiments according to the present invention provide a cooling structure and method which can employ one or more modules. Each of the modules supports one or more heat exchange elements in the form of tube bundle panels in the illustrated example. The construction of tube bundle panels themselves for cooling of fluid and/or condensing of steam is known.

The structures disclosed herein can support any suitable type of heat exchange element, and for example any type of panel or grid used for cooling and/or condensing fluid. Such panels may have relatively flat or curved profiles, and may have square, rectangular, triangular or other shapes. In one example, each of the tube bundle panels comprises a plurality of typically parallel tubes through which a fluid or steam is passed in order to cool the fluid or steam. Supply headers feed the fluid or steam to the parallel bundle tubes and return headers remove the cooled fluid or condensate from the parallel bundle tubes.

Some embodiments as described below provide a desirable support structure for supporting such tube bundle panels. Some preferred embodiments will now be described with reference to the drawing figures, in which like reference numbers refer to like parts throughout.

FIG. 1 is a perspective view of a cooling facility 10, in this case used an air-cooled condenser for condensing steam, according to one embodiment of the present invention. The overall facility 10 includes four modules 12 arranged in a row. The modules 12 are substantially the same as each other, except that the modules 13 on the ends may be constructed somewhat differently than the modules 15 in the middle.

Figure 4:
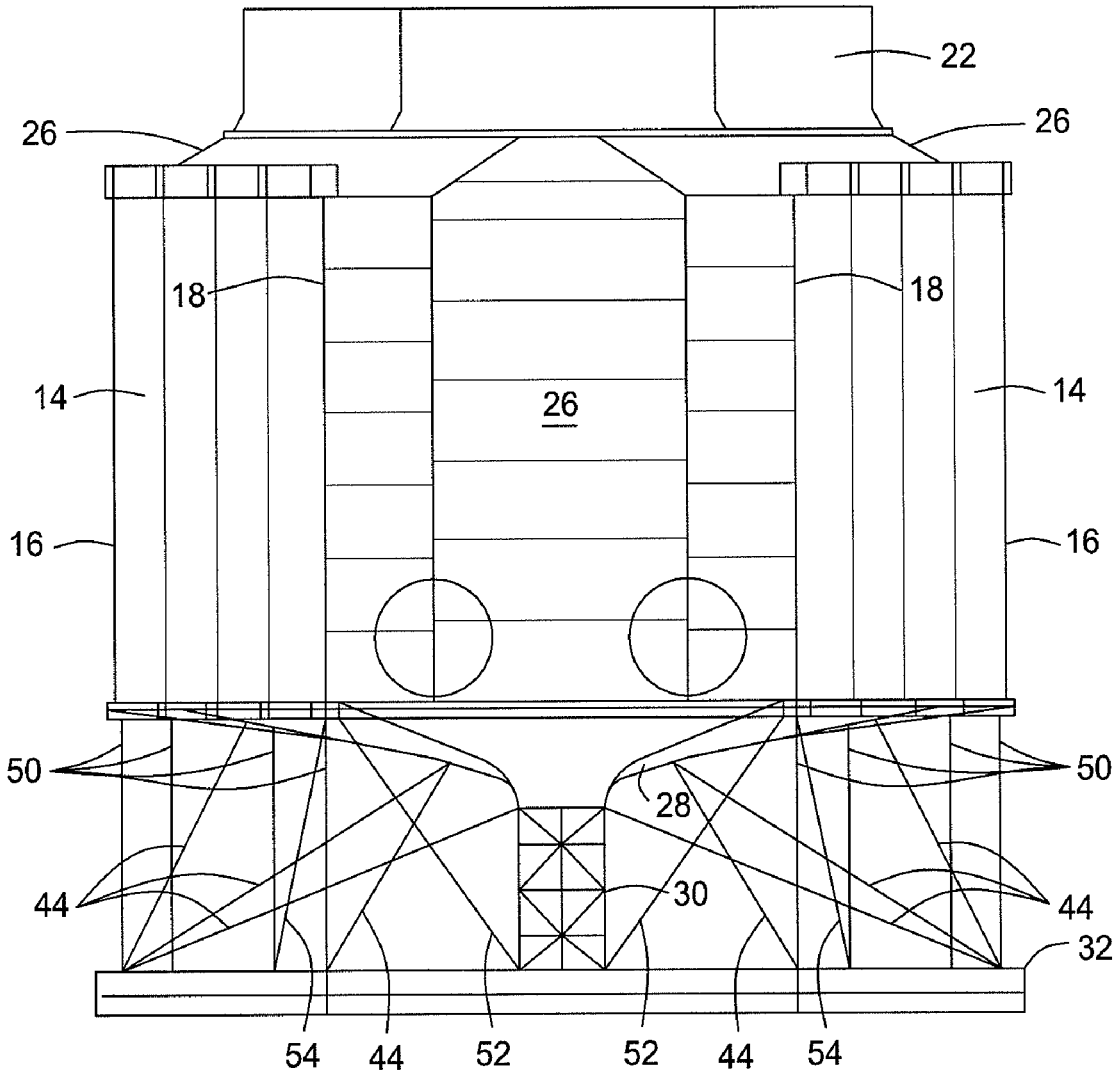
FIG. 4 is an end view of the cooling facility of FIG. 1.
Figure 5:
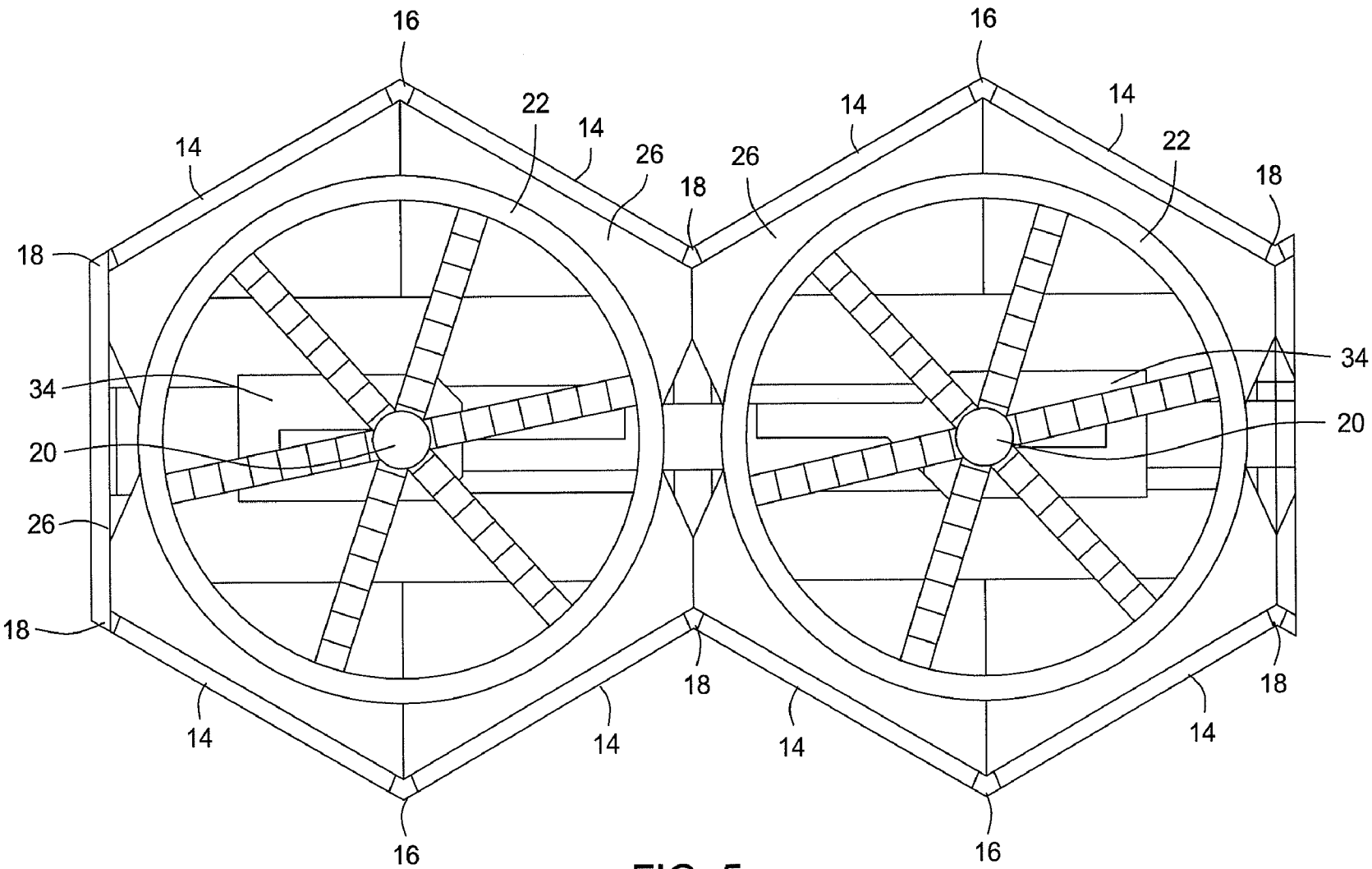
FIG. 5 is a top view of a portion of the cooling facility of FIG. 1.

In general, it will be appreciated that each module 12 has a total of four tube bundle panels 14 with the panels 14 being arranged in dihedral angle pairs (see FIGS. 4 and 5). That is, on one side of each module 12, two panels 14 are attached to each other by hinges 16 and are at an angle to each other. In some embodiments, this nominal included angle between the panels may be approximately 120°. The panel pairs 14 are also hinged at their outer ends by hinges 18 to a support structure which will be described in more detail below. It will be appreciated that this arrangement allows the panels 14 to expand, in which case the hinges 16 will be urged outward slightly and the included angle will decrease slightly. This can accommodate thermal expansion of the tube bundle panels 14 while having them still be attached to the supporting structure at their respective hinges 18.

Each module 12 also includes an outlet fan 20 which is surrounded by a fan shroud ring 22. The fan 20 and shroud 22 are supported by an internal support structure that is described in more detail below. A fabric top covering 24 spans between the fan shroud 22 and the panels 14. The modules 12 can have their internal volumes isolated from each other at their adjoining sides by a fabric end barrier 26 between adjacent modules 12. The end modules 13 also feature fabric end barriers 27 on their exposed outer ends.

Each module 12 is supported by a central support column 30, as well as a pair of end support structures and a variety of peripheral support legs that will be described with respect to further drawings. A bottom fabric covering 28 is also provided so that in combination to the other fabric coverings 24, 26 and 27, an air flow path is defined in which air entering the tower is essentially restricted to entering through the tube bundle panels 14, and exiting via the outlet fan 20.

Although the example illustrated will involve four modules 12 with the two end modules 13 being substantially identical to each other and the two interior modules 15 being substantially identical to each other, other individual modules can be constructed as well as longer or shorter rows of modules including the case of a single module. Also, although the module examples 12 described herein are six-sided examples in which four of the six sides have tube bundle panels 14, it will be appreciated that other shapes can be employed and a different number of sides of the other shapes, or a different number of sides of a six-sided shape, can incorporate or omit tube bundle panels. Also, although steam condensing tube panel bundles are described as an example of a suitable heat exchange medium, other heat exchange medium can be supported instead, or in addition by the support structures disclosed herein.

Figure 2:
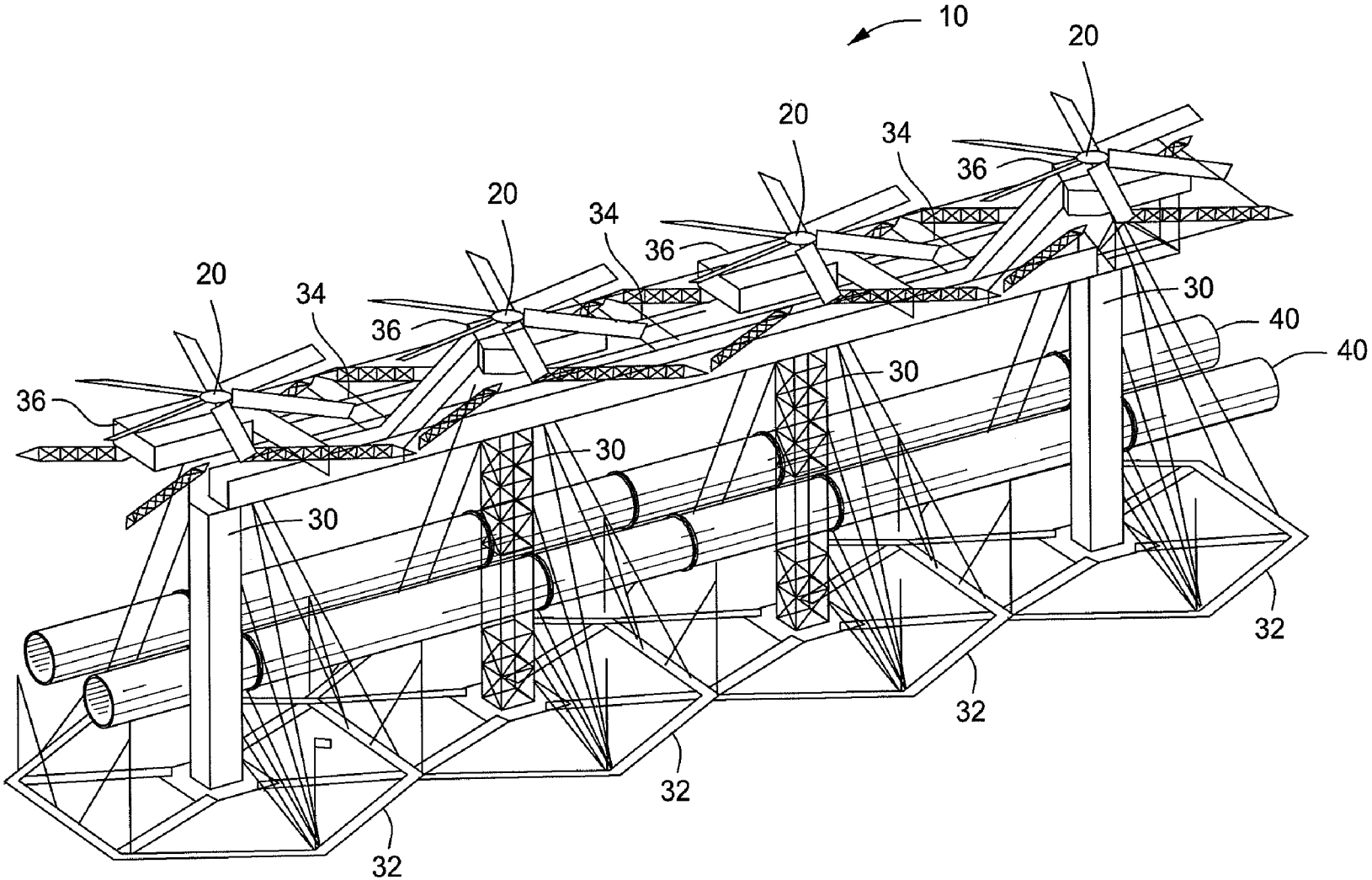
FIG. 2 is a cutaway view showing some internal components of the cooling facility of FIG. 1.

Turning next to FIG. 2, the facility 10 rests upon a footing structure 32 which can be essentially a concrete foundation having a configuration such as the shape illustrated. The central support columns 30 can each be a square section truss space frame having a stairway disposed inside to permit a worker to enter the frame and climb it. The columns 30 support a longitudinal frame 34 which rests on the tower 30. The longitudinal frames 34 in the middle modules 15 are each two-piece structures being two longitudinal and horizontal arms extending outward from the leg of the column 30 as shown to create a T-shape at the top of each column 30. The frames 34 thus form a longitudinal spine and walkway through the modules 12 and are aligned with each other. A doorway can be placed into the fabric 26 separating the modules, to permit a worker to pass from one module 12 to the other within the longitudinal frames 34. The longitudinal frames 34 provide a number of support features which are described in more detail below. Further, the longitudinal frames 34 provide a mounting location for the drive system 36 of each fan 20. A benefit of this is that the drive system 36 can be located in a direct-drive fashion with the fan 20 avoiding the need for a complex lengthy drive system, and with most of the vertical load of the fan drive weight load being passed more or less directly downward through the column 30. FIG. 1 shows the central columns of the outer modules 13 being covered in fabric at their lower end, whereas the columns 30 in the intermediate modules 15 are shown exposed. The fabric can be provided or omitted at these locations depending on desired airflow characteristics and access to the center of the column 30.

Figure 9:
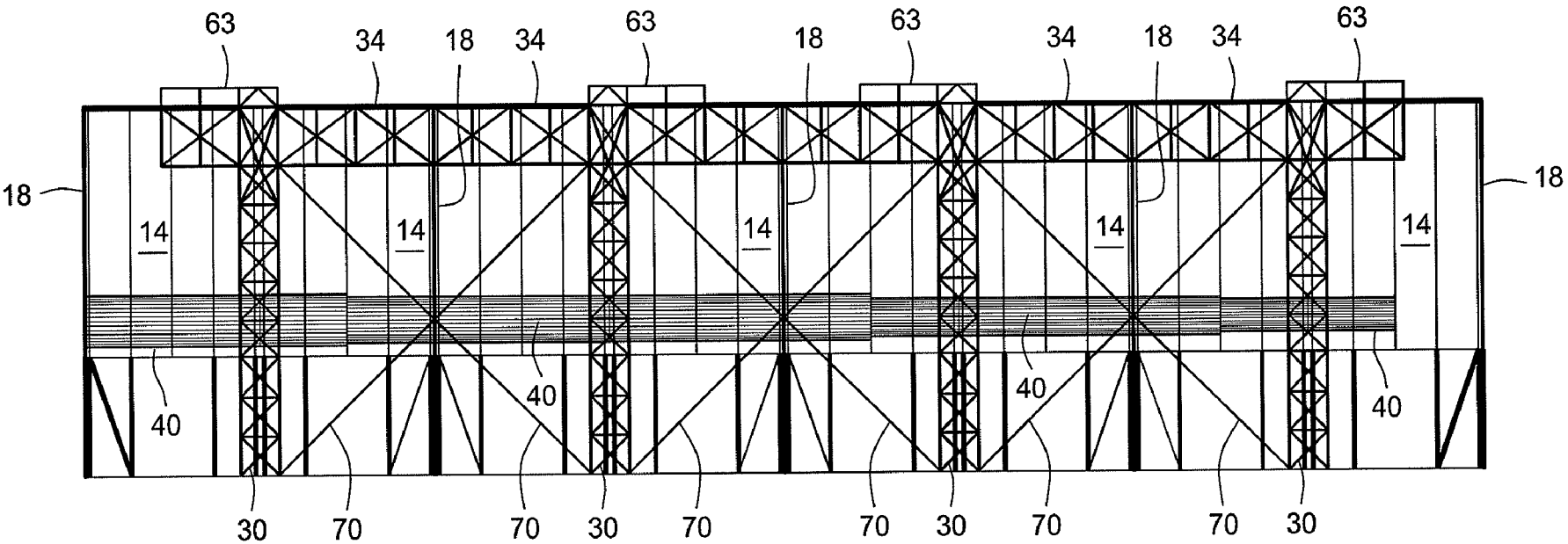
FIG. 9 is a schematic side view showing the layout of some internal structure of the cooling facility of FIG. 1.

FIG. 2 also illustrates a pair of steam supply pipes 40 running through each of the modules. These supply pipes provide steam (or other fluids to be cooled) to the panels 14 via a header system which is not shown. The return system of the condensed steam, or cooled fluid, is also not shown. As shown in FIG. 9, the supply pipes 40 can decrease in diameter along the length of the facility 10.

FIGS. 1 and 2 also depict a number of guy wires and support legs which will be described in more detail below, and which are not labeled in FIGS. 1 and 2 in order to simplify the figures.

Figure 3:
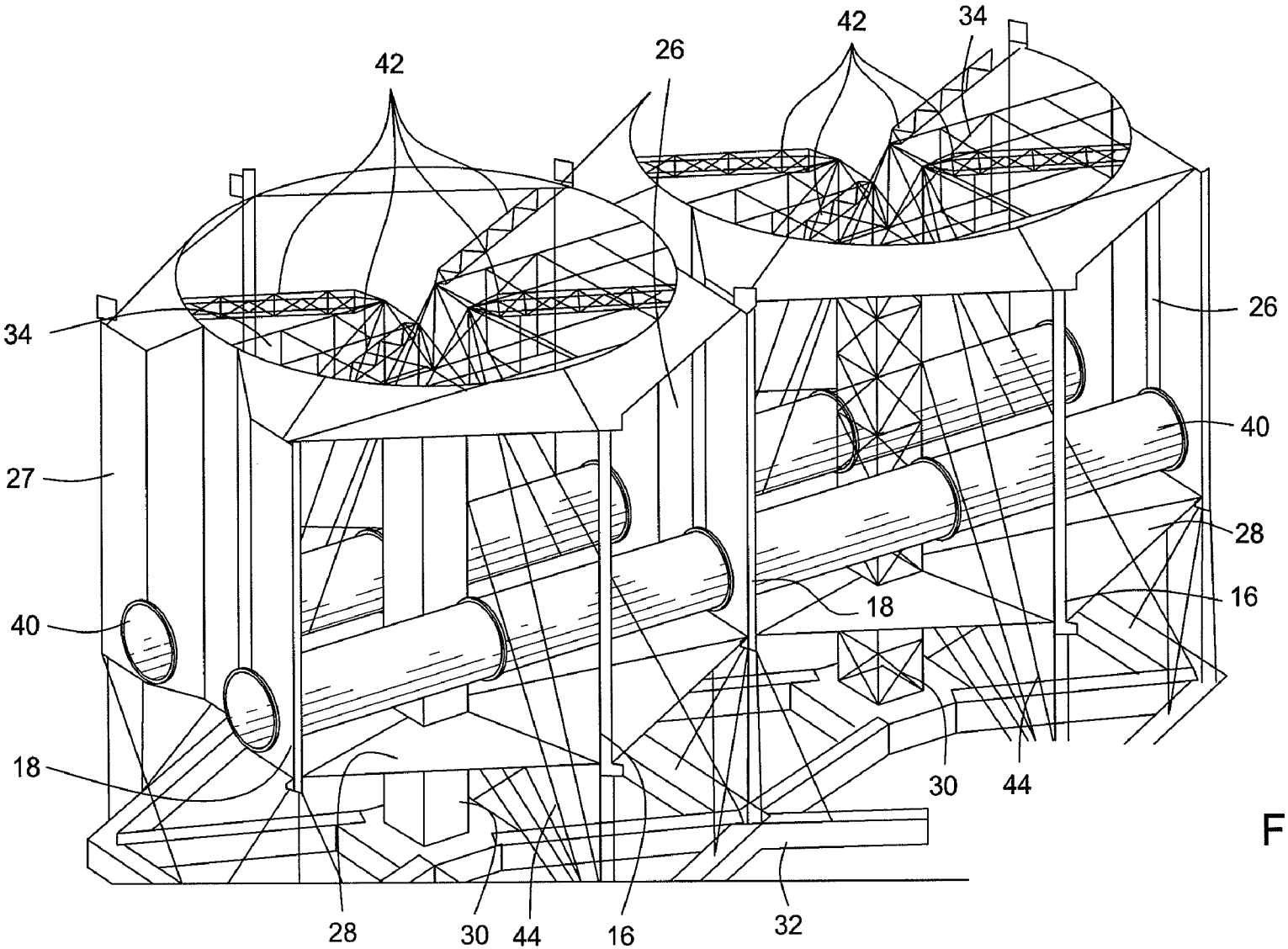
FIG. 3 is a partial cutaway view also showing some internal components of the cooling facility of FIG. 1.

Turning to FIG. 3, it will be appreciated that each module 12 also has four radial compression arms 42 extending outwardly from the intersection of the column 30 and longitudinal frame 34. FIG. 3 is also labeled to identify some items that have been discussed above with respect to FIGS. 1 and 2. In addition, internal guy wires 44 are provided which span from portions of the column 30 down to the footing 32 to stabilize the column 30. The guy wires 44 penetrate through the fabric bottom cover 28.

FIG. 4 is an end view which illustrates a number of the components that have been discussed above. In addition, FIG. 4 depicts a system of legs including vertical support legs 50 which undertake some vertical load of supporting the weight of the panels 14, as well as diagonal legs 52 and 54 which also assist with this purpose. It will be appreciated when viewing FIG. 4 that since the hinges 16 located at the top and the bottom of the dihedral panel pairs 14 move laterally outwardly upon expansion, that at least some of the support legs 50 may advantageously be hinged or pivoted at their ends so they can move slightly off the vertical while still providing substantial vertical load support.

Fabric structures close (1) the vertical gap between the "active faces" and, as well, between the partition walls and the "active faces", (2) the hexagonal horizontal surface at the base of the "active faces" as well as the transversal partition or gable wall, and (3) the space between the fan shroud and the top of the finned tube bundles.

In some embodiments, every welded structural element or component is sized as large as possible, but in such a way to be easily hot galvanized and packed in standard maritime containers, in order to limit on site mechanical connections.

Figure 6:
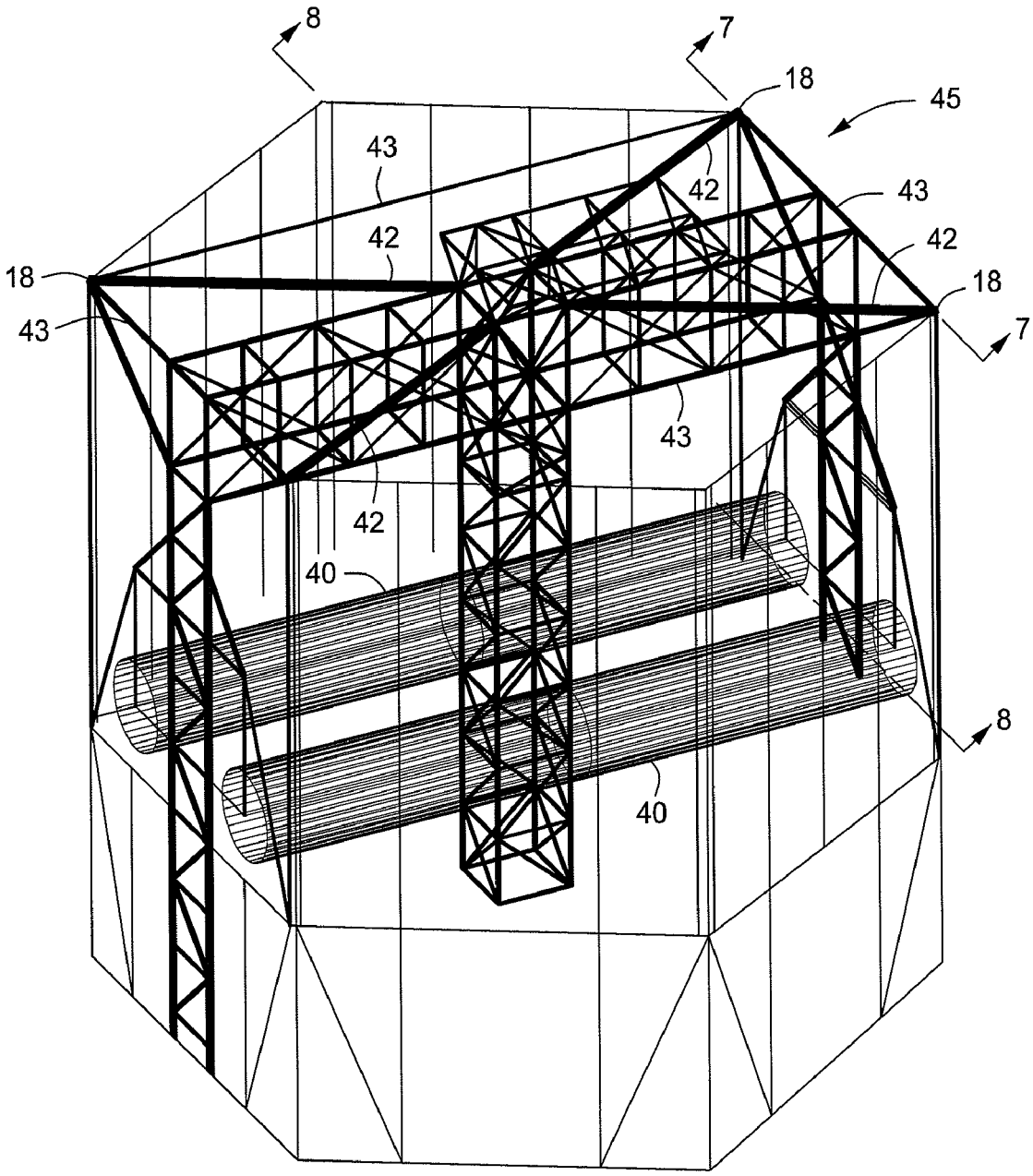
FIG. 6 is a perspective view schematically illustrating some internal components of the upper portion of a single module used in the cooling facility of FIG. 1.
Figure 7:
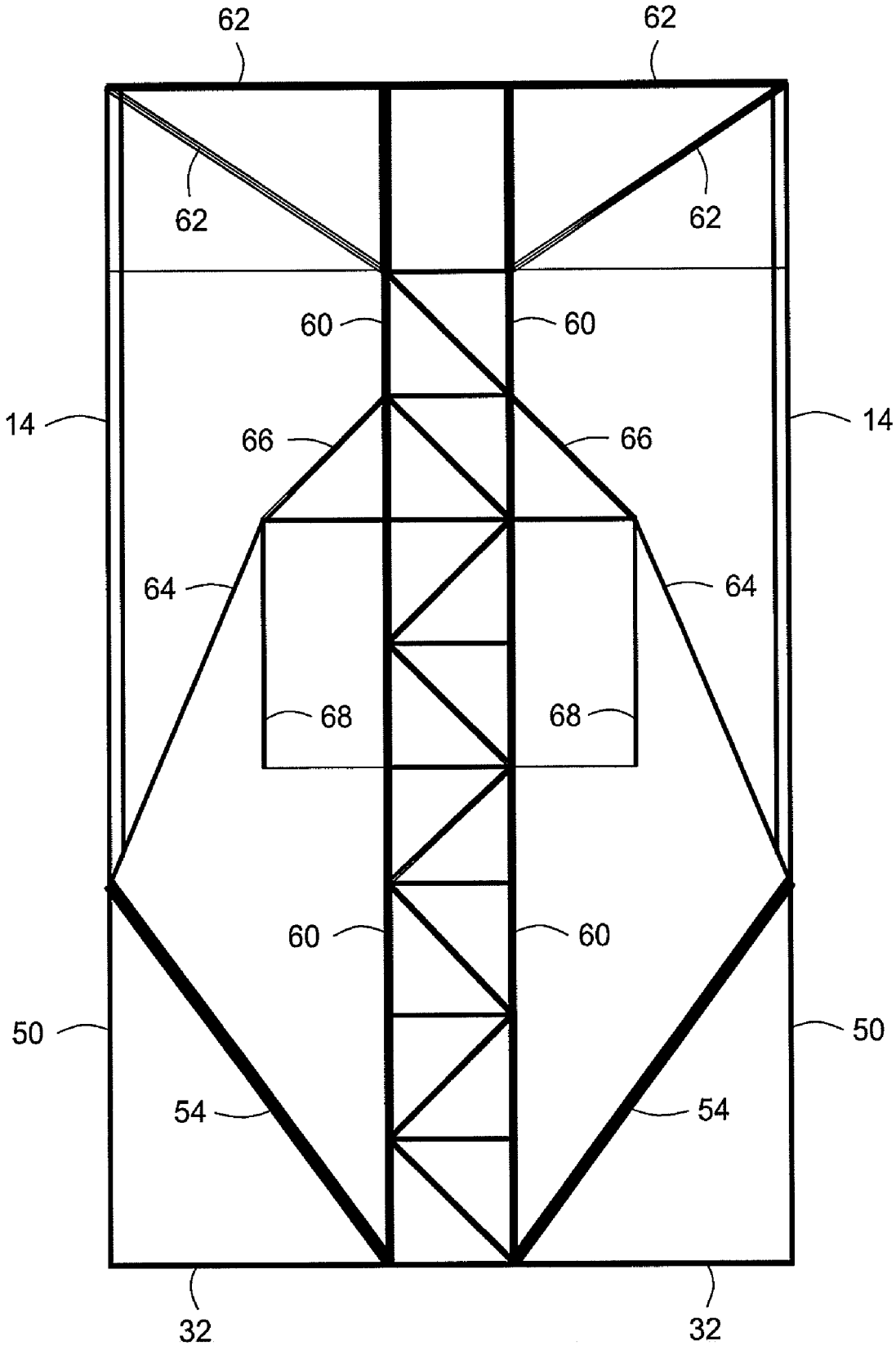
FIG. 7 is a schematic diagram taken as an end view of an end wall structure at line 7-7 as shown on FIG. 6 of a module used in the cooling facility of FIG. 1.

FIG. 5 is a top view showing two modules and some of the elements that are discussed in this description. FIG. 6 is a cutaway view further illustrating the support structure of a module 12. For convenience in interpreting FIG. 6, FIGS. 7 and 8 will be discussed first. FIG. 7 shows part of the support structure existing on both of the end sides (non-tube bundle panel sides) of the structure. These are the ends that have the fabric 26. These ends are either the exposed outer ends of the facility 10 or are the intermediate adjoining location of adjacent modules. Each of these ends has a central vertical ladder frame 60 extending upward from the footing 32. The "vertical transversal bracing system" (with also support the partition wall) between each cell is composed of a central truss (d) column headed by 2 cantilever arms (e) fixed at their end by 2 vertical tension cables or rods (f).

Figure 8:
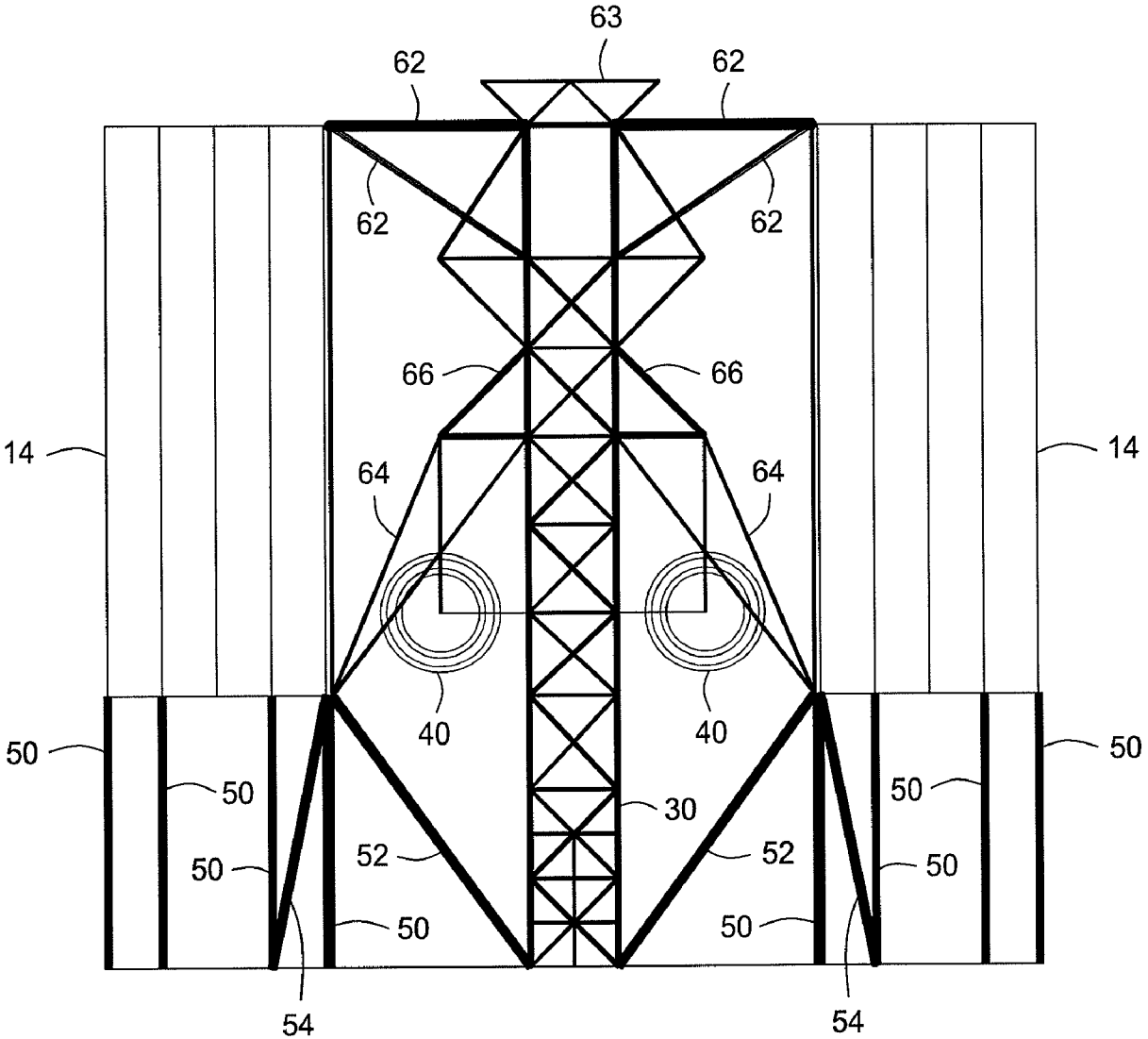
FIG. 8 is a cross-sectional view taken through a center line 8-8 of a module according to FIG. 6.

Additional prestressed cables with horizontal struts (i) increase the stiffness of the system. Struts (i) also transfer the horizontal load at base of the bundles to the system. Horizontal loads such as from earthquakes on the main ducts are transferred to the system with struts. Support cables 68 can also be suspended by the cantilever arms 66 and such cables 68 can provide vertical support to the steam supply tubes 40 (not shown in FIG. 7). FIG. 8 schematically depicts the pipes 40 hanging from cables 68. In addition, the diagonal support legs 54 are also provided as shown.

Turning next to FIG. 8, a cross-section is taken through the center of a module, while also showing the structure of the remaining half of the module. Thus, the center column 30 and panels 14 are superimposed on the structure of FIG. 7. In addition, further support legs 50, 52 and 54 are visible in this view. FIG. 8 also shows a support truss 63 on top of the column 30 for supporting the fan drive 36.

FIG. 6 also schematically illustrates the provision of the four compression arms 42. These compression arms 42 are tied by cables 43 to form a rectangular cable/strut system 45. The rectangular cables 43 in conjunction with the compressions arms 42 forms a rigid rectangular planar cable/strut structure 45 which provides a constant parallel spacing between the end barrier 26. Further, this rectangular cable/strut structure 45 provides for the four hinge corners 18 to remain in their correct position when viewed in plan view. That is, for example, the rectangular outline 45 formed by the cables 43 and the compression struts 42 positively locate the hinge points 18 regardless of expansion of the panels 14.

FIG. 9 is a side schematic view of various items including aspects of the support framework that have been described above. In this example the longitudinal frames 34 of the end modules do not extend all the way to the outer ends of the outer end modules 13 The central columns are braced longitudinally between them by two oblique tension cables or rods in a cross pattern, horizontal forces are absorbed by the foundations at tower base and by the longitudinal walkway on top of columns. The longitudinal walkway is made of a series of truss beams resting between columns where they are linked together by the mean of a pair of lateral cantilever structure (d). The longitudinal steam ducts are hung to the cantilever by mean of two tension rods or cables (b).

The transversal bracing of the tower is provided by the "top horizontal truss" (hereunder described)transferring the horizontal load to a "vertical transversal bracing system" (hereunder describe) placed at mid distance between the columns as well as at the gables. The "top horizontal truss" is composed of 4 compression struts connecting the 4 upper corners at the columns to the 4 longitudinal corners of each hexagonal cell. Those 4 corners are connected by tension cables or rods forming a rectangle.

Figure 10:
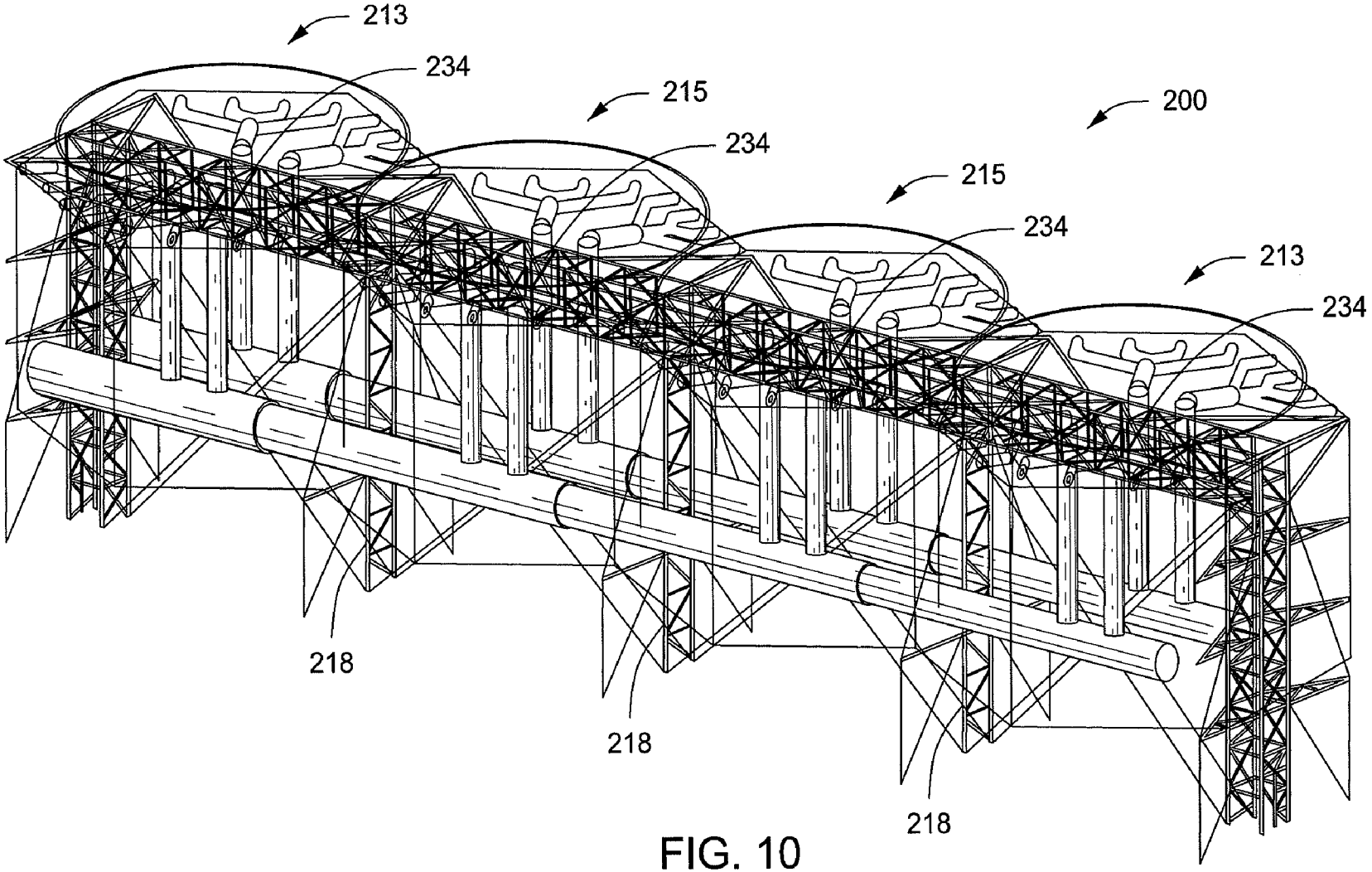
FIG. 10 is a perspective schematic view of a second embodiment.

FIG. 10 shows a second embodiment. In this embodiment, parts that are illustrated similar to those shown in the embodiment of FIG. 1 are indeed some more parts, and are thus not necessarily labeled or further described. For example, the transfer panels in this embodiment 200 are substantially the same as the heat transfer panels described with respect to FIG. 1. Further, the lower leg portions can be substantially the same as the lower leg portions used in the embodiment of FIG. 1, and a foundation (not illustrated) similar to that of FIG. 1 can be used. Further, this embodiment includes a series of modules shown in FIG. 1 and each module has a top fan. In addition, fabric can be used as desired at the bottom of the modules, and around the outside edges of the fan, as well as the exposed end of the tower arrangement.

Figure 12:
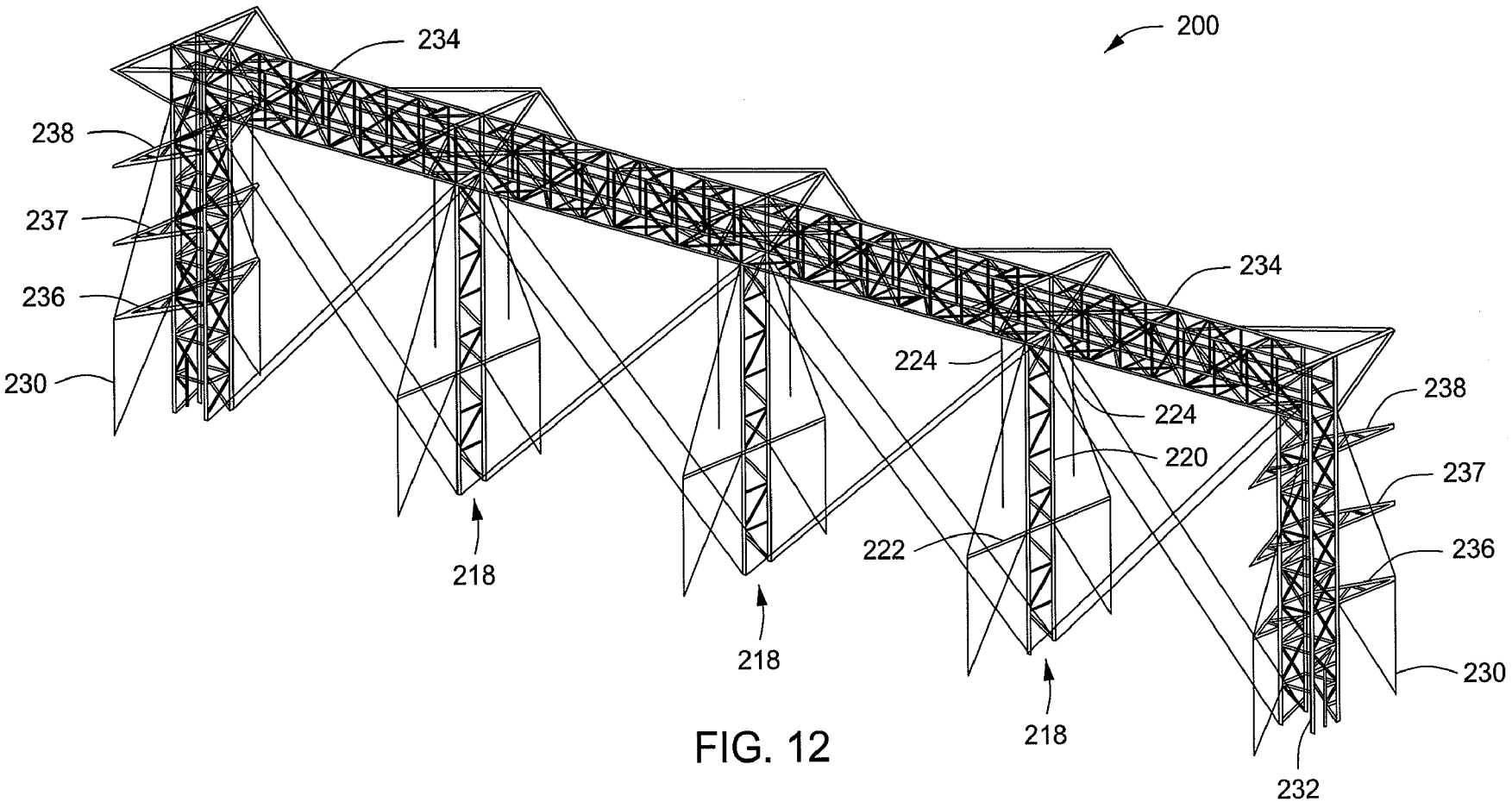
FIG. 12 is a perspective cutaway view of the second embodiment of FIG. 10.

The embodiment 200 differs in that it does not necessarily utilized any structure corresponding to the central support columns 30 of the first embodiment of FIG. 1. Instead, the longitudinal top horizontal truss or frames 234 are in the case of the embodiment 200 supported by side support structures, which are described in more detail below. The longitudinal frames 234 span the length of the tower 200 in a fashion similar to that of the embodiment of FIG. 1, and provides support for the fan drives, as well as a walkway across the generally top area of the tower 200. The arrangement shown in FIG. 10 includes two intermediate modules 215 as well as to end modules 213. Interior modules 215 each have at their sides a side support structure at their intermediate adjoining wall 218. These intermediate structures 218 are particularly well viewed in FIG. 12. The side support frames 218 include a center truss portion 220 as well as arms 222 and various other associated support structures, including wires 224 for suspending the steam supply pipes. At the outer end of the tower 200, end supports 230 are provided. These supports 230 differ somewhat from the supports 218, and include a square section space frame truss 232 forming a column upward to a longitudinal end of the longitudinal frame 234, as well as a number of lateral support arms 232, 233 and 234, extending outwardly as shown. It will be appreciated that this embodiment has the benefit of eliminating the extra central columns present in the first embodiment, although in the illustrated example it does involve a more robust outer side structure 230 compared to the first embodiment where the side structures 18 are all the same, whether they are between two modules or on the outer end of the tower.

Figure 11:
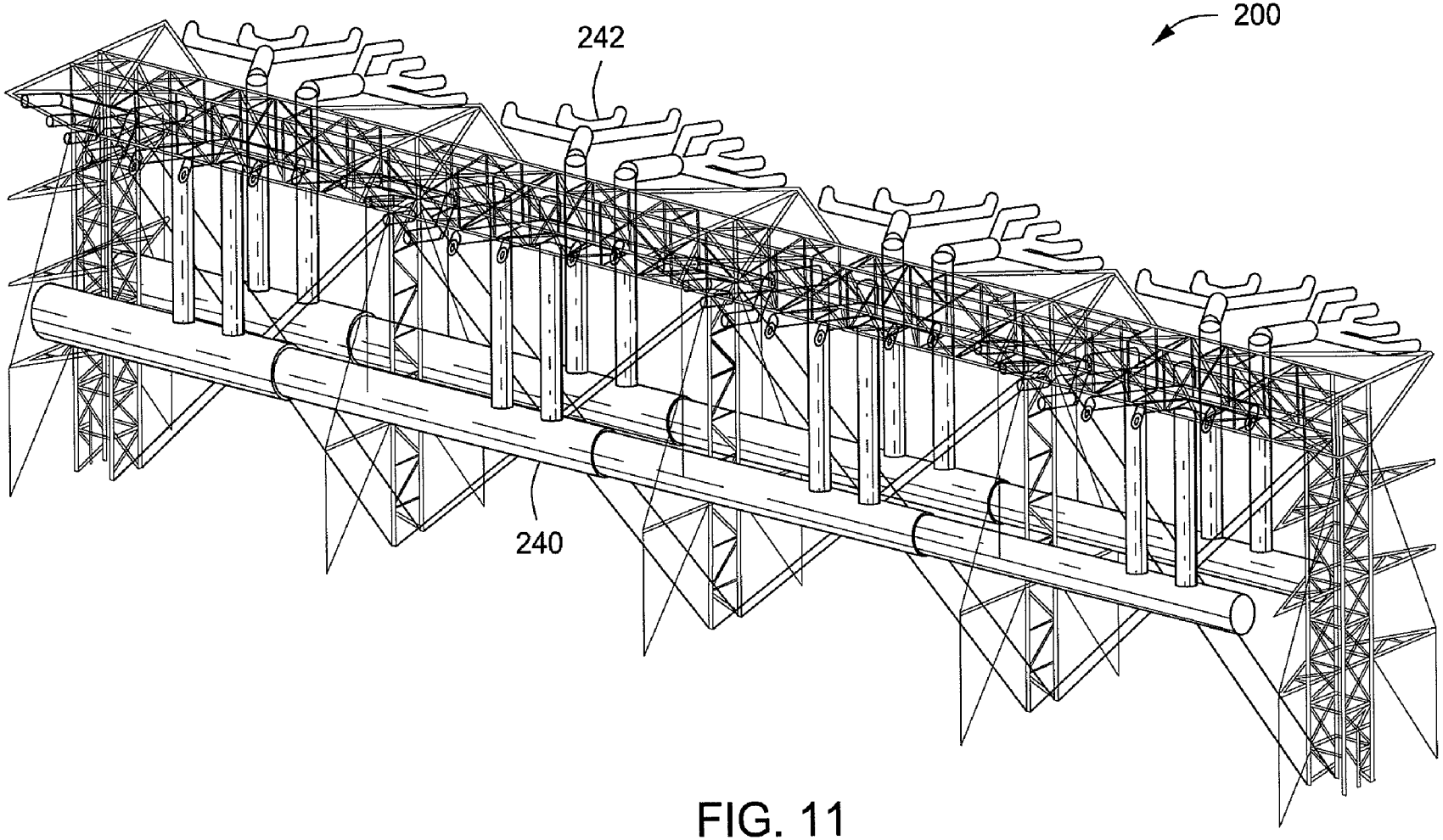
FIG. 11 is a perspective cutaway view of the second embodiment of FIG. 10.
Figure 13:
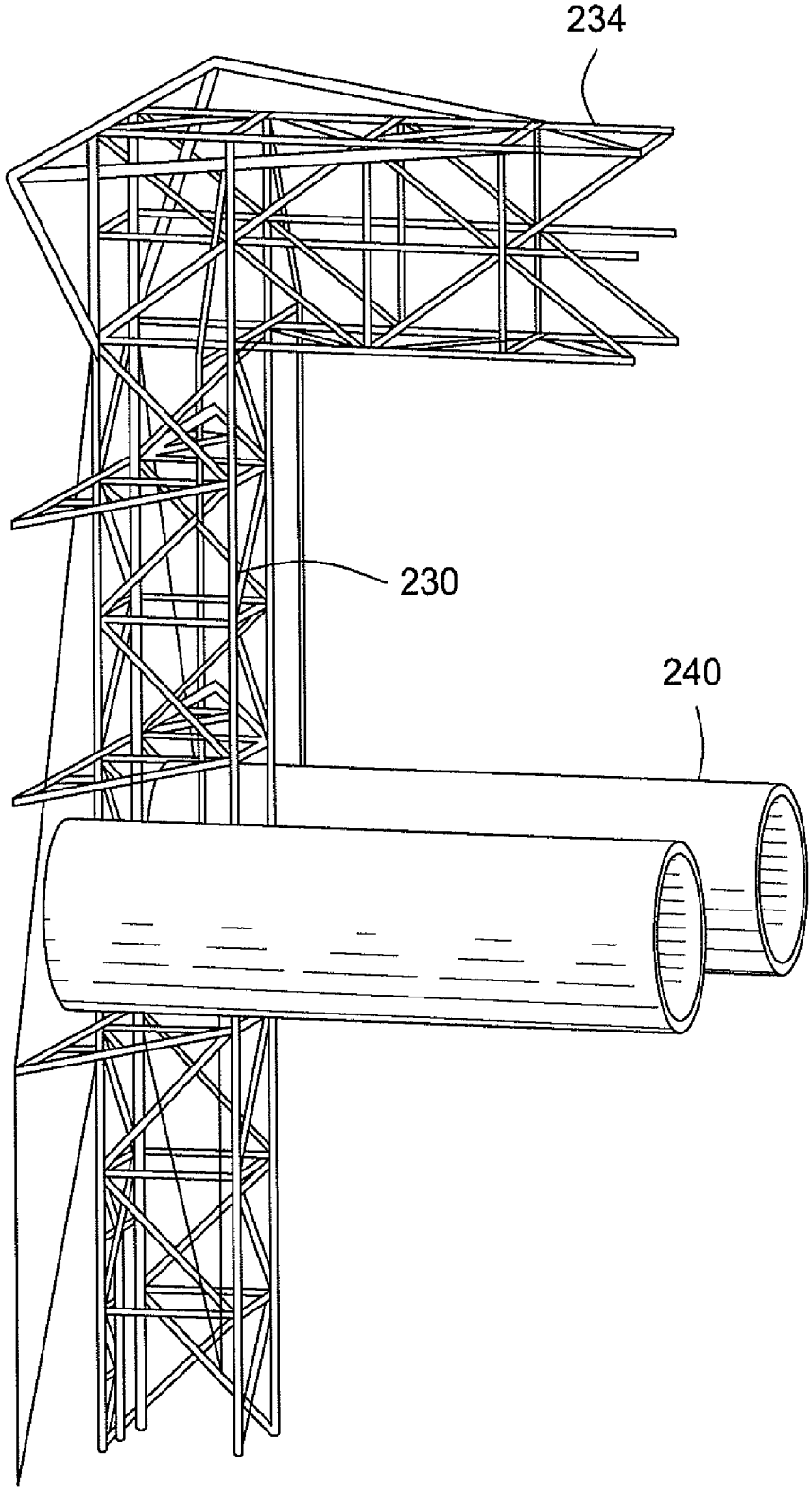
FIG. 13 is a partial perspective cutaway view of the second embodiment of FIG. 10.
Figure 14:
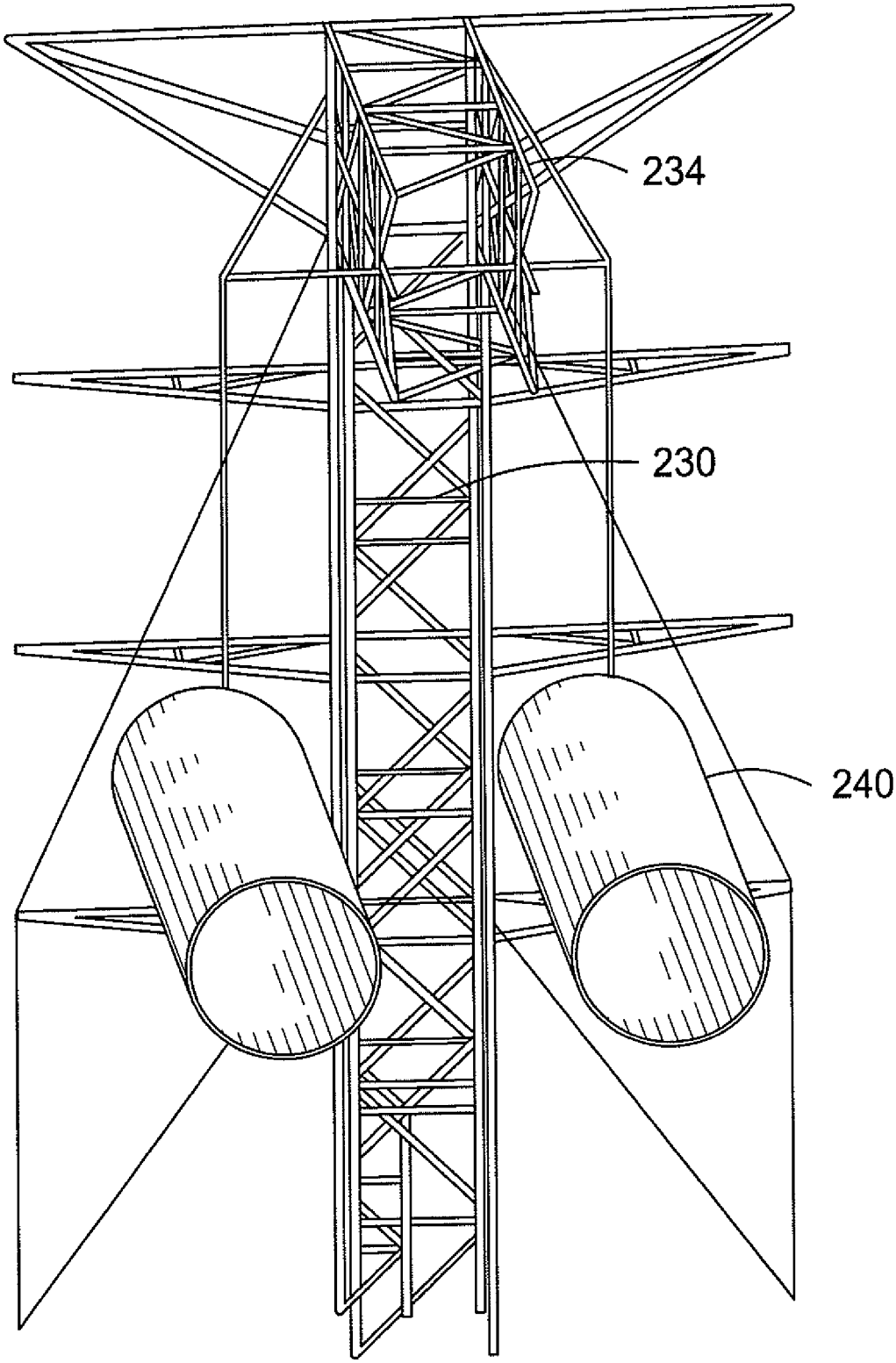
FIG. 14 is a partial perspective cutaway view of the second embodiment of FIG. 10.
Figure 15:
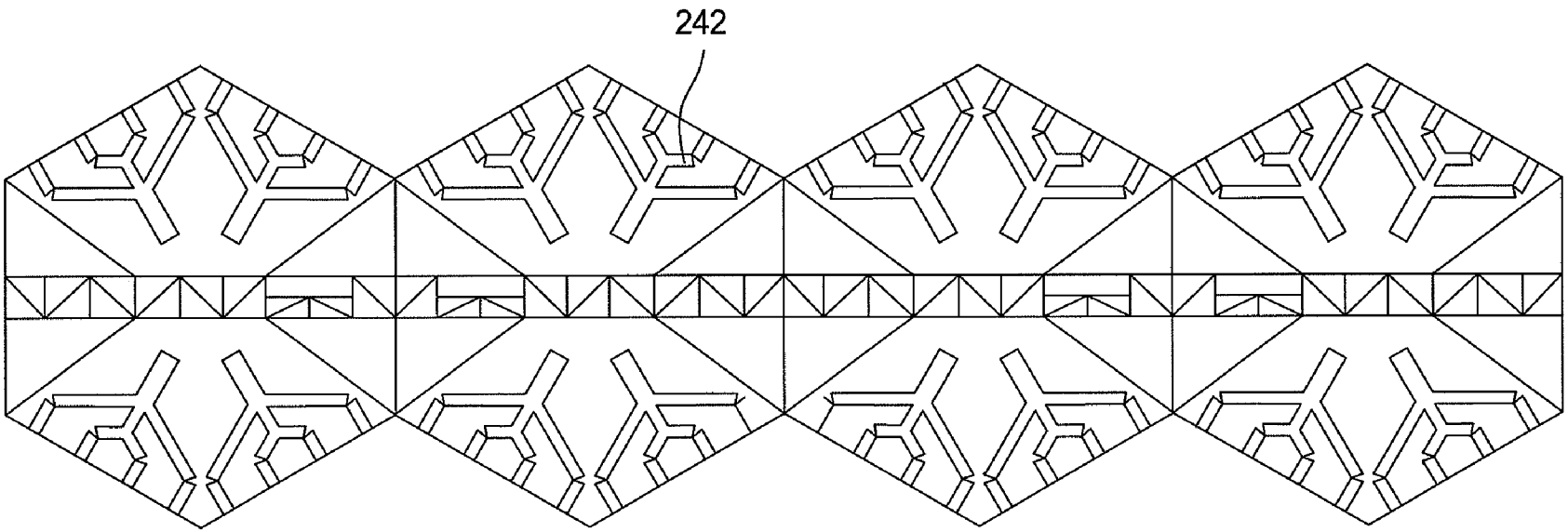
FIG. 15 is a schematic top view of a steam header tube arrangement used in the second embodiment shown in FIG. 10.

FIG. 11 also shows the interaction of the structure with a steam supply pipe 240 as well as a series of headers 242 that supply the various heat transfer panels. FIGS. 13 and 14 further show the location and support of the steam tubes 240 relative to the end structures 230, and FIG. 15 is a top view showing an example of a pattern of steam supply headers 242 that may be implemented.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A cooling tower module, comprising:

at least one heat exchange panel;

a central space truss column;

a space truss horizontal beam extending outward from the central column; and a pair of first side structures connected to the horizontal beam to support the horizontal beam and connected to the heat exchange panel to provide support to the at least one heat exchange panel.

2. The tower module according to claim 1, further comprising a concrete foundation on which the central column rests.

3. The tower module according to claim 1, further comprising at least one leg disposed beneath the panel to provide support to the at least one heat exchange panel.

4. The tower module according to claim 3, further comprising a concrete foundation on which the central column and the leg rest.

5. The tower module according to claim 1, wherein the horizontal beam extends at least from the central column to the first side structure.

6. The tower module according to claim 5, wherein the first side structure comprises a cantilever arm, and a cable attached to the cantilever arm and to the at least one heat exchange panel to provide support for the at least one heat exchange panel.

7. The tower module according to claim 1, further comprising a second side structure on an opposed side of the first side structure, wherein the first and second side structures support the at least one heat exchange panel.

8. The tower module according to claim 7, wherein the at least one heat exchange panel comprises two separate heat exchange panels, with each heat exchange panel spanning between the first and second side structures.

9. The tower module according to claim 8, comprising a hinge connecting the two panels to form a dihedral angle.

10. The tower module according to claim 9, wherein the tower is hexagonal in plan view, with the first and second side structures being opposed to each other, and the dihedral angle panel pairs being opposed to each other.

11. The tower module according to claim 2, wherein the at least one leg is pivotally connected to the panel and to the foundation, to accommodate the thermal expansion of the panel.

12. The tower module according to claim 1, further comprising a stairway disposed in the central column.

13. The tower module according to claim 1, wherein the heat exchange panel comprises a tube bundle.

14. The tower module according to claim 1, wherein the cooling module is an air-cooled steam condenser and at least one heat exchange panel is a condenser panel.

15. A cooling tower facility, comprising:

a plurality of modules, each module comprising:

at least one heat exchange panel;

a central space truss column;

a space truss horizontal beam extending outward from the central column; and a pair of first side structures connected to the horizontal beam to support the horizontal beam and connected to the heat exchange panel to provide support to the at least one heat exchange panel.

* * * * *